US005831198A

United States Patent [19]

Turley et al.

[11] Patent Number: 5,831,198

[45] Date of Patent: Nov. 3, 1998

[54] MODULAR INTEGRATED WIRE HARNESS FOR MANPORTABLE APPLICATIONS

[75] Inventors: Douglas G. Turley, Ontario; Tom S. Quan, Monterey Park, both of Calif.; Dennis Carlson, Bloomfield Hills, Mich.; Rohinton P. Billimoria, El Segundo, Calif.; Gary J. Mladjan, Torrance, Calif.; Douglas A. Anderson, Long Beach, Calif.

[73] Assignee: Raytheon Company, El Segundo, Calif.

[21] Appl. No.: 590,013

[22] Filed: Jan. 22, 1996

[51] Int. Cl.[6] ..... B64D 1/04; A45F 3/08

[52] U.S. Cl. ..... 89/1.11; 224/930; 224/262

[58] Field of Search ..... 89/1.11; 42/100; 224/930, 902, 261, 262; 434/11, 14, 16

[56] References Cited

U.S. PATENT DOCUMENTS

| | | | |
|---|---|---|---|
| 405,436 | 6/1889 | Shelton | 224/902 |
| 448,128 | 3/1891 | Crisp et al. | 224/902 |
| 2,676,207 | 4/1954 | Hunt | 224/262 |
| 4,970,589 | 11/1990 | Hanson et al. | 224/930 |
| 5,426,295 | 6/1995 | Parikh et al. . | |
| 5,456,886 | 10/1995 | Scherer | 224/262 |
| 5,474,452 | 12/1995 | Campagnuolo | 434/11 |

FOREIGN PATENT DOCUMENTS

| | | |
|---|---|---|
| 2 400 864 A | 3/1979 | France . |
| 40 03 960 A | 8/1990 | Germany . |
| WO 95 12105 A | 5/1995 | WIPO . |

*Primary Examiner*—Charles Jordan
*Assistant Examiner*—Theresa M. Wesson
*Attorney, Agent, or Firm*—Leonard A. Alkov; William C. Schubert; Glenn H. Lenzen, Jr.

[57] ABSTRACT

The wiring harness assembly of the present invention is an electrical and structural network which serves as a distribution system for the command/control signals and power of a comprehensive warfare system. The warfare system, which in worn by an individual soldier, contains multiple subsystems. The wiring harness assembly includes four distinct segments which allow each subsystem to communicate with a central microprocessor and with each other. The wiring harness assembly includes the Torso Segment which is partially embedded within the frame of an equipment carrier borne by the individual soldier. The embedded portion of the wiring harness assembly is protected from any harsh environment that may be encountered by the soldier. Other segments include the Integrated Helmet Assembly Subsystem Segment, the Weapon Subsystem Segment, and the Sensor Subsystem Segment which provide the electrical network for a variety of equipment options available to the soldier.

13 Claims, 5 Drawing Sheets

MODULAR INTEGRATED WIRE HARNESS FOR MANPORTABLE APPLICATIONS

BACKGROUND OF THE INVENTION

The present invention relates generally to a modular wire harness and associated components. More specifically, the invention relates to an electrical wiring system through which various subsystems of a warfare system communicate with a central microprocessor and each other.

Modern technology, especially computers and electronics, have advanced rapidly in the recent past. It is only logical that these technological advances would be applied to the art of war, specifically to weapons and other equipment designed to make the modern soldier a more efficient fighting machine.

One approach for applying the technological advances to modernize the soldier is to view the soldier as one part of a comprehensive warfare system. This warfare system approach gives a soldier the ability to devise real-time solutions to problem situations and keeps the soldier responsive and flexible enough to operate in an uncertain and frequently dangerous environment.

The first major system to propose the system warfare approach was the Soldier Integrated Protective Ensemble ("SIPE"), developed experimentally by the U.S. Army. The SIPE experiment attempted to integrate multiple electronics subsystems and related elements and to provide the soldier-user with easy-to-use means to interface with those subsystems. The lessons learned from the SIPE experiment led to the development of a new generation of warfare system known as the Land Warrior ("LW"), which is currently being pursued by a number of defense contractors. The LW includes improvements in communications, computing, night vision, weaponry, ballistic protection, and load carrying capability while providing the individual soldier with enhanced lethality, command and control, survivability, mobility, and sustainment.

The LW system is divided into various subsystems, each subsystem consisting of similar or related hardware and software which is dedicated to accomplishing a certain task or family of tasks. The LW system is composed of five such subsystems: (1) Computer/Radio Subsystem ("CRS"); (2) Weapon Subsystem ("WS"); (3) Integrated Helmet Assembly Subsystem ("IHAS"); (4) Protective Clothing and Individual Equipment Subsystem ("PCIES"); and, (5) LW Software Subsystem ("SS").

For the subsystems to effectively communicate with a central microprocessor and with each other, a comprehensive electrical/electronic network must be a part of a warfare system. Such a network must also provide the means for the soldier-user to receive, process, and possibly transmit critical data. In the SIPE experiment, many of the electrical cables which allowed the subsystems to "talk" to the central microprocessor and to each other were located on the exterior of the soldier and his equipment. Problems arose when exterior cables became snagged on brush or other rough terrain encountered by the soldier, resulting in damaged wires or connectors. Furthermore, the relatively large number of exterior cables necessitated a corresponding number of connectors. A large number of connectors then increased the chances of one of them shorting out in inclement weather or failing in some other way.

SUMMARY OF THE INVENTION

The wiring harness assembly of the present invention is specifically designed to overcome the problems experienced with the SIPE system or others like it. The wiring harness assembly is an electrical network which is made up of four distinct segments that distribute the command and control signals and power throughout the LW system. The present invention utilizes internal cables, self-coiling wires, and improved environmentally sealed connectors wherever possible.

The Torso Segment is the main portion of the wiring harness assembly and links the CRS to the other LW subsystems. The Torso Segment is made up of cables and wires partially enclosed within the hollow frame of the soldier's load carrying equipment ("LCE"). The hollow frame offers protection from the external environment and thereby increases the reliability of vital subsystem communication.

The remaining three segments are also important: the IHAS Segment connects the Integrated Helmet Assembly Subsystem with the CRS; the WS Segment connects the Weapon Subsystem with the CRS; and, the Sensor Segment connects a variety of sensor-related components, for example, a weapon-mounted video camera, to the Weapon Segment of the wiring harness assembly, which in turn is connected to the CRS.

The invention itself, together with further objects and attendant advantages, will be best understood by reference to the following detailed description, taken in conjunction with the accompanying drawings.

DETAILED DESCRIPTION

Figure 1:
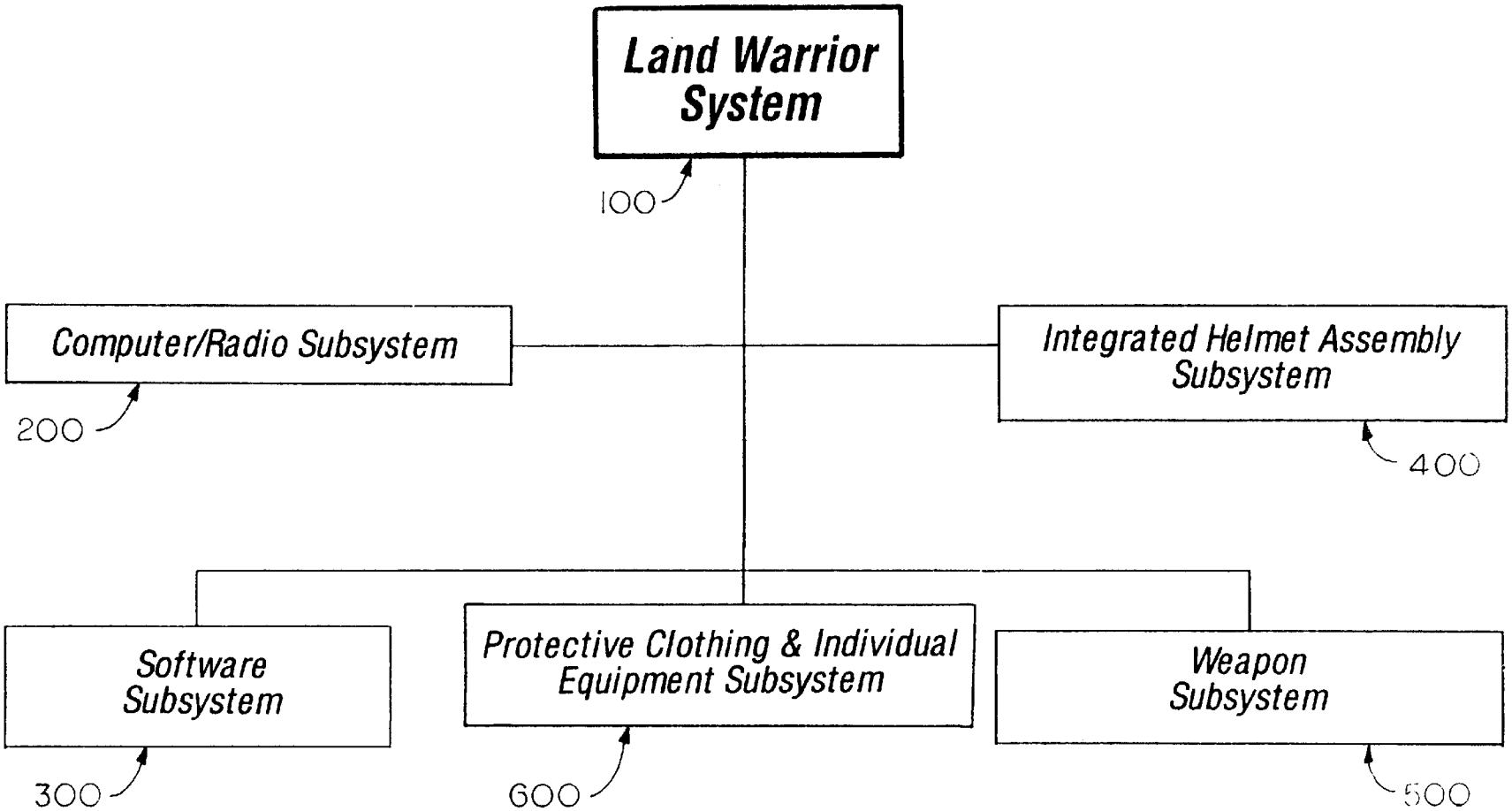
FIG. 1 is a block diagram of the LW system which incorporates the wiring harness assembly of the present invention.
Figure 2:
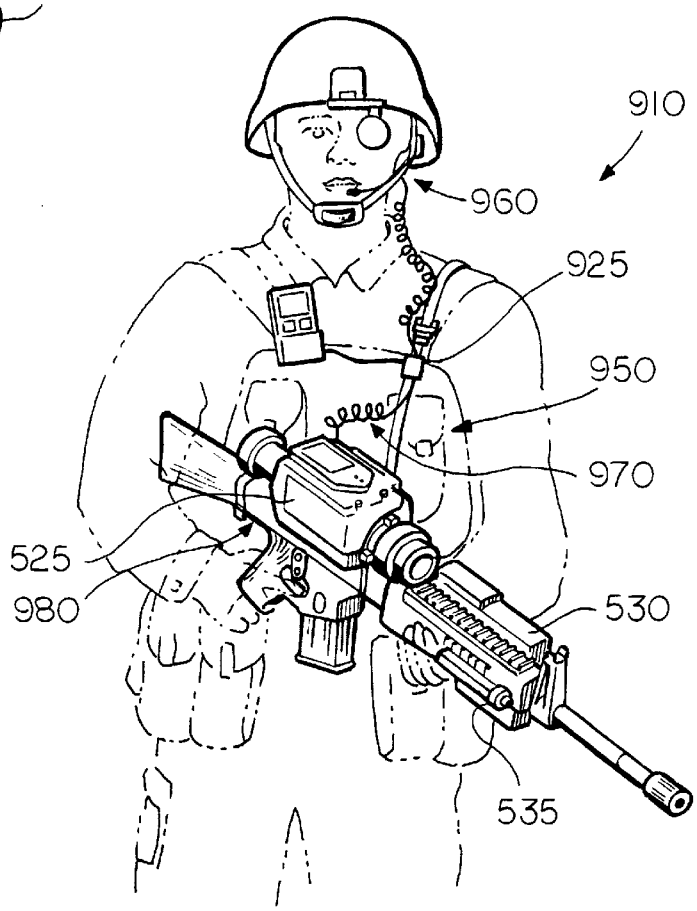
FIG. 2 is a front perspective view of the wiring harness assembly of the present invention as it is worn by an individual soldier.

The Wiring Harness Assembly ("WHA") 910 of the present invention is made up of four segments that distribute the command and control signals and power throughout the LW system 100, shown in FIG. 1. FIG. 2 illustrates an overview of the WHA 910 of the present invention. The Torso Segment 950 is the main portion of the WHA 910 and links the Computer/Radio Subsystem ("CRS") 200 to the other LW subsystems. The Torso Segment 950 is partially enclosed within the load carrying equipment (LCE) structure, as further described herein. The IHAS Segment 960 connects the Integrated Helmet Assembly Subsystem 400 with the CRS 200. The WS Segment 970 connects the weapon Subsystem 500 with the CRS 200. The Sensor Segment 980 connects sensing equipment such as a weapon-mounted video camera 535 with the CRS 200. All of the segments are interconnected via subsystem interface connectors.

Figure 3A:
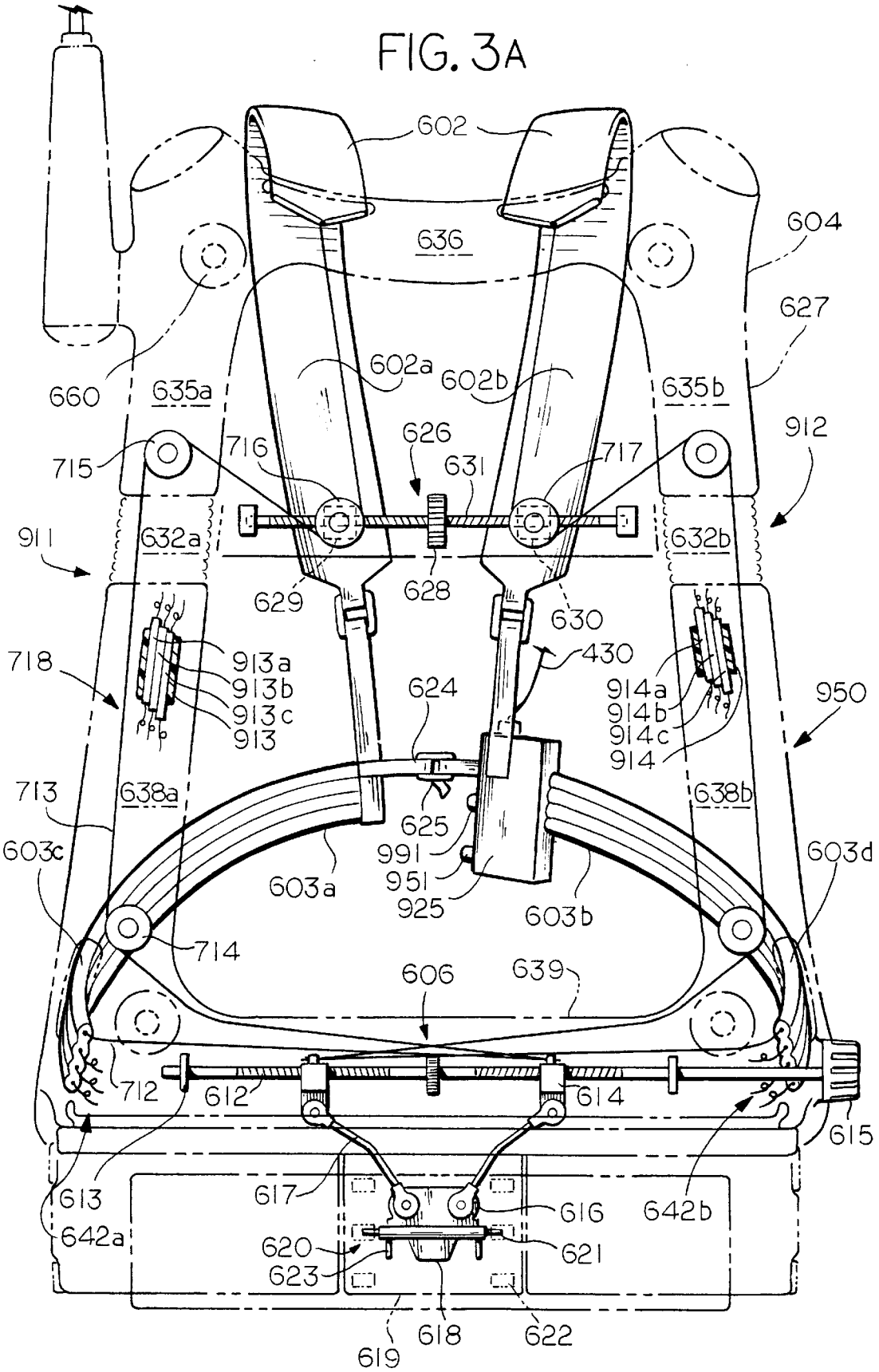
FIG. 3*a* is a rear elevational view of the Torso segment of the present invention.

As shown in FIG. 3*a*, the Torso Segment 950 is made up of a variety of wires partially enclosed within the LCE frame 604 which protects it from external environments and thereby increases signal reliability. The LCE frame 604 which is generally rectangular in shape is constructed as follows. The LCE frame 604 has two vertical support member assemblies 911 and 912, each having three distinct parts: the vertical support member assembly 911 is made up of an upper vertical support member 635*a*, a flex point 632*a*, and a lower vertical support member 638*a*; the vertical support member assembly 912 is made up of an upper vertical support member 635*b*, a flex point 632*b*, and a lower vertical support member 638*b*. Connecting one vertical support member 911 with the other 912 is upper horizontal support member 636 and lower horizontal support member 639.

Contained within vertical support member assemblies 911 and 912 are cables 913 and 914, respectively, containing the wires 913*a–c* and 914*a–c* which provide power and control signals to various electronic components, further described herein. Cables 913 and 914 may include three types of wire: 30 AWG, ultra flex, high strand, film insulated wire 913*a* and 914*a* for command and control signals; miniature shielded coax cable 913*b* and 914*b* with braided shielding for sensitive video and radio frequency signals; and, 24 AWG, ultra-flex, insulated wire with low resistance 913*c* and 914*c* for power distribution and grounding.

Extending from the LCE frame 604 are two rib cage straps 603*a* and 603*b* constructed of a moisture impervious material such as vinyl, urethane, or the like. The rib cage strap 603*a* extends from inside the LCE frame 604, through strap opening 603*c*, around one side of the soldier and joins sternum strap 624 and shoulder strap 602*a*. On the other side, rib cage strap 603*b* extends from inside the LCE frame 604, through strap opening 603*d* and around the other side of the soldier. Rib cage strap 603*a* is slidable through strap opening 603*c* and rib cage strap 603*b* is slidable through strap opening 603*d*, allowing rib cage straps 603*a* and 603*b* (along with wires 642*a* and 642*b* embedded therein) to be adjusted to fit the individual soldier. By keeping rib cage straps 603*a* and 603*b* snug against the torso of the soldier, snags may be avoided.

Figure 6:
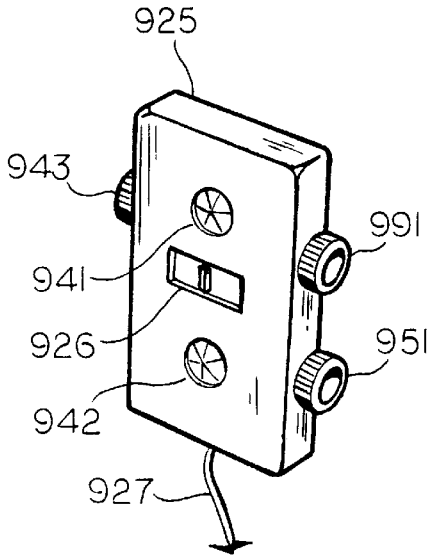
FIG. 6 is a front perspective view of the junction block of the present invention.

As shown in FIG. 3*a*, junction block 925 is located at the place where the sternum strap 624, shoulder strap 602*b*, and rib cage strap 603 all intersect (in the general vicinity of the soldier's chest area). The junction block ("JB") 925, also shown in FIG. 6, provides a durable, lightweight, central interconnection point to link the various subsystems with the CRS 200 and with each other. Features of the JB 925 include a three-position switch 926, two recessed thumbwheel rotary potentiometers 941 and 942, and three connectors 943, 951, and 991. The three-position switch 926 allows the soldier to select a display for viewing information. The thumbwheel 941 in used to adjust the contrast of the IHAS-mounted display 432 and the thumbwheel 942 is used to adjust the brightness of the IHAS-mounted display 432, discussed further herein. Connectors 943, 951, and 991 are used to receive incoming cables from the outlying subsystems. In the preferred embodiment of the present invention, the wires 642*b* encased in rib cage strap 603*b* terminate directly into the JB 925, as shown in FIG. 3*a*. If a mirror image configuration is used, the JB 925 is located at the end of rib cage strap 603*a* and the wires 642*a* encased in the rib cage strap 603*a* would still terminate directly into the JB 925, as shown in FIG. 3*a*. For a fully redundant system, a junction block is mounted in both locations (i.e., at the end of both straps 603*a* and 603*b*), providing the highest degree of reliability.

In an alternate embodiment, the JB 925 may be physically secured to one of the rib cage straps 603*a* or 603*b* with snaps or the like and the JB/CRS cable 927 way be wired from the bottom of the JB 925 to the CRS 200. The JB cable 927 contains approximately 80 signal and power conductor wires (not shown) which interface with the CRS 200. The JB cable 927 interconnects to the CRS 200 through a single, low-profile 100-pin connector (not shown) which is located at the bottom of the CRS 200.

Figure 3B:
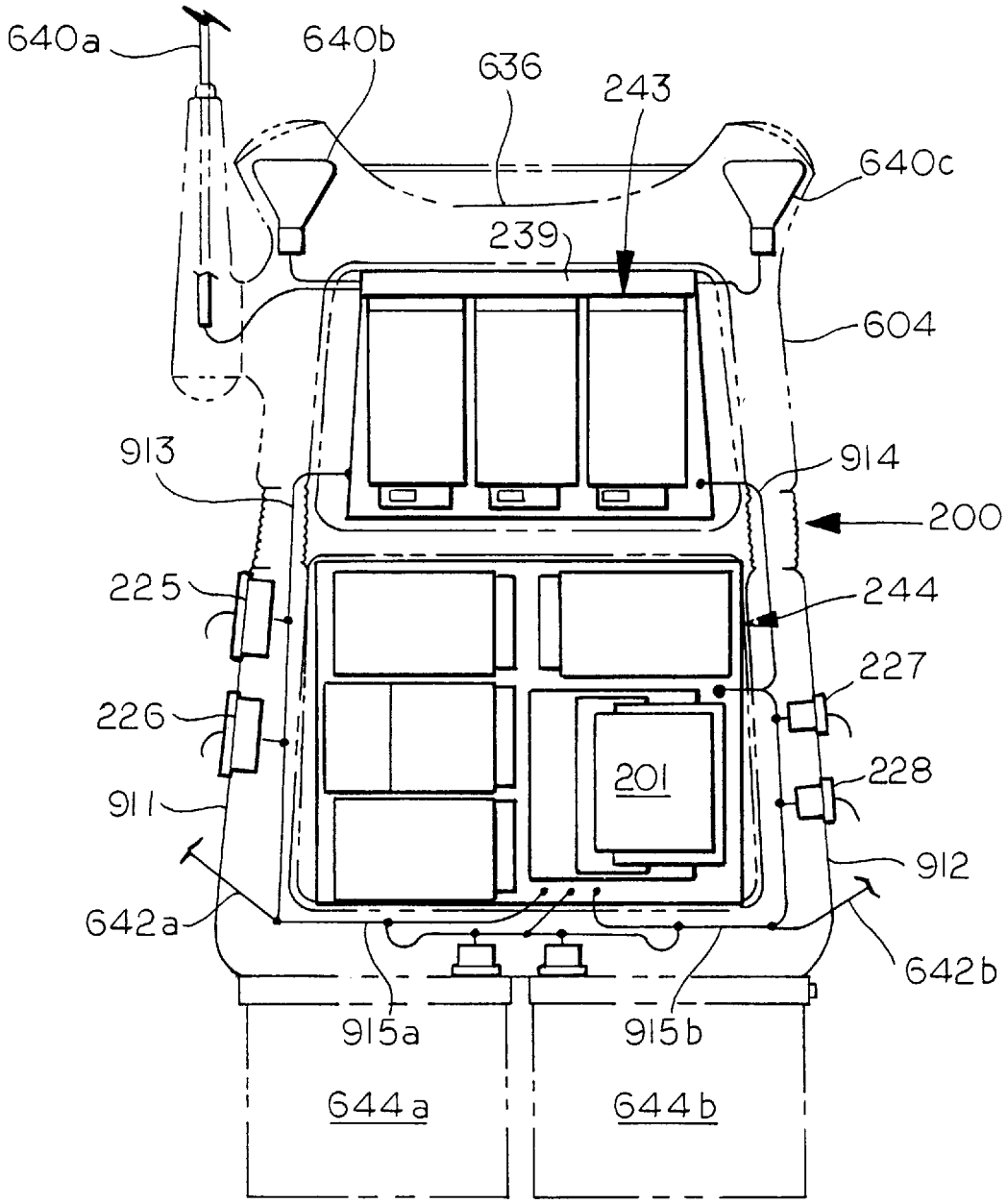
FIG. 3*b* is a wiring schematic of the Torso Segment of the present invention.

The electrical connections for the Torso segment are illustrated in FIG. 3*b*. Power is provided by batteries 644*a* and 644*b* through wires 915*a* and 915*b* to a power bus (not shown) which feeds the radio module 243 and the computer module 244. In the preferred embodiment, a primary set of power and control wires 913*a–c* are routed through the cable 913 in the vertical support member assembly 911 and a redundant set of power and control wires 914*a–c* are routed through the cable 914 in the vertical support member assembly 912. Redundant wiring paths decrease the likelihood of signal failure due to wiring damage or malfunction. Similarly, a primary set of power and control wires 642*a* are embedded within the rib cage strap 603*a* to the JB 925 and a redundant set 642*b* are embedded within the rib cage strap 603*b* to the JB 925. Radio antennas 640*a–c* are connected to their respective radios (not shown) in the radio module 243 via the radio bus 239. In a less costly version, power may be routed in one vertical support member assembly 911 and control signals may be routed in the other vertical support member assembly 912, or vice versa.

The CRS 200 may also include interfaces which are wired into the wiring harness assembly 910 for use with external components. For example, external interfaces 225 and 227 are standard 25-pin and 9-pin, respectively, RS232 input/output ports for use with various devices, such as a Mini Eyesafe Laser Infrared Observation Set ("MELIOS"), not shown, a combat ID device, not shown, or another LW system computer, not shown; external interface 226 is a remote connector for use with a remote Single Channel Ground Airborne Radio System ("SINGCARS"), not shown; and interface 228 is a standard government DS101 connector which way be used for inputting crypto-variables for secure communications or inputting codes to access high level GPS accuracy, for example.

Figure 4:
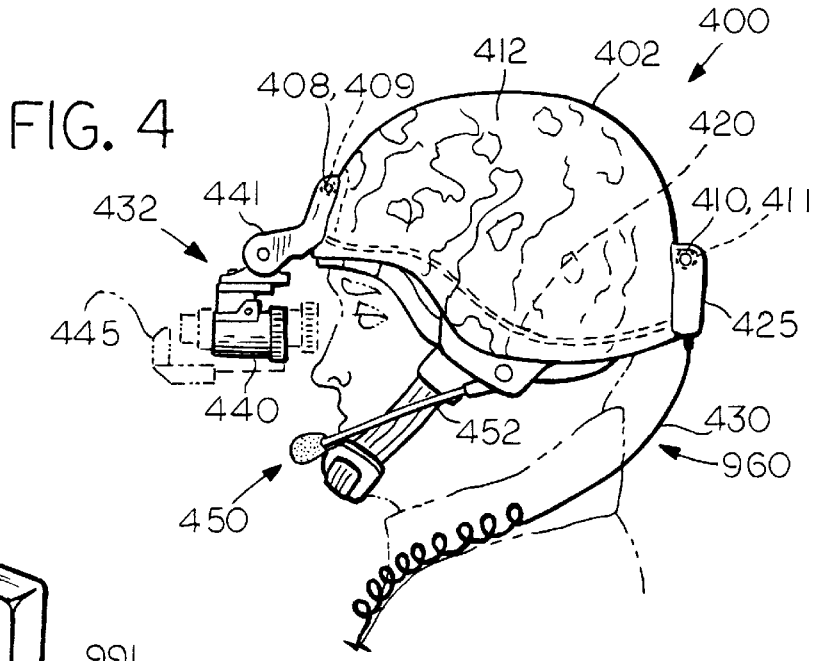
FIG. 4 is a side elevational view of the IHAS segment of the present invention.

The IHAS segment 960, shown in FIG. 4, electrically connects all of the electronic equipment of the IHAS 400 to the CRS 200. The Day Component ("DC") display 440 and Night Sensor/Display Component 445 display ("NSDC"), jointly referred to as the Sensor Display Assembly 432, are wired through the DC/NSDC helmet mount 441 to the Display Electronics Module 425 via the IHAS display cable 420. The Sensor Display Assembly 432 is a two-piece monocular device which provides the soldier with display capabilities from various components throughout the subsystems. The IHAS display cable 420 runs along the lower edge of the outer surface of the helmet shell 402 but is hidden beneath the cloth cover 412. The Display Electronics Module 425 is wired to the CRS 200 through the junction block 925 via the self-coiling IHAS cable 430 and either rib cage strap cable 603*a* or 603*b*. A cable tie-down (not shown) may be used to secure cable 430 to either shoulder strap 602*a* or 602*b*.

The Weapon Segment 970 of the wiring harness assembly of the present invention is made up of a self-coiling cable 599 which extends from the side of the weapon 501 to the CRS 200 via the JB 925 and wires 642*a* or 642*b*. The self-coiling feature ensures that the cable 599 extends with the movements of the soldier and contracts to prevent excess cable from catching on loose brush and impeding the mobility of the user or damaging equipment. The cable 599 utilizes easily operated locking connectors (not shown) which are designed with an integral breakaway safety mechanism (not shown).

Figure 5:
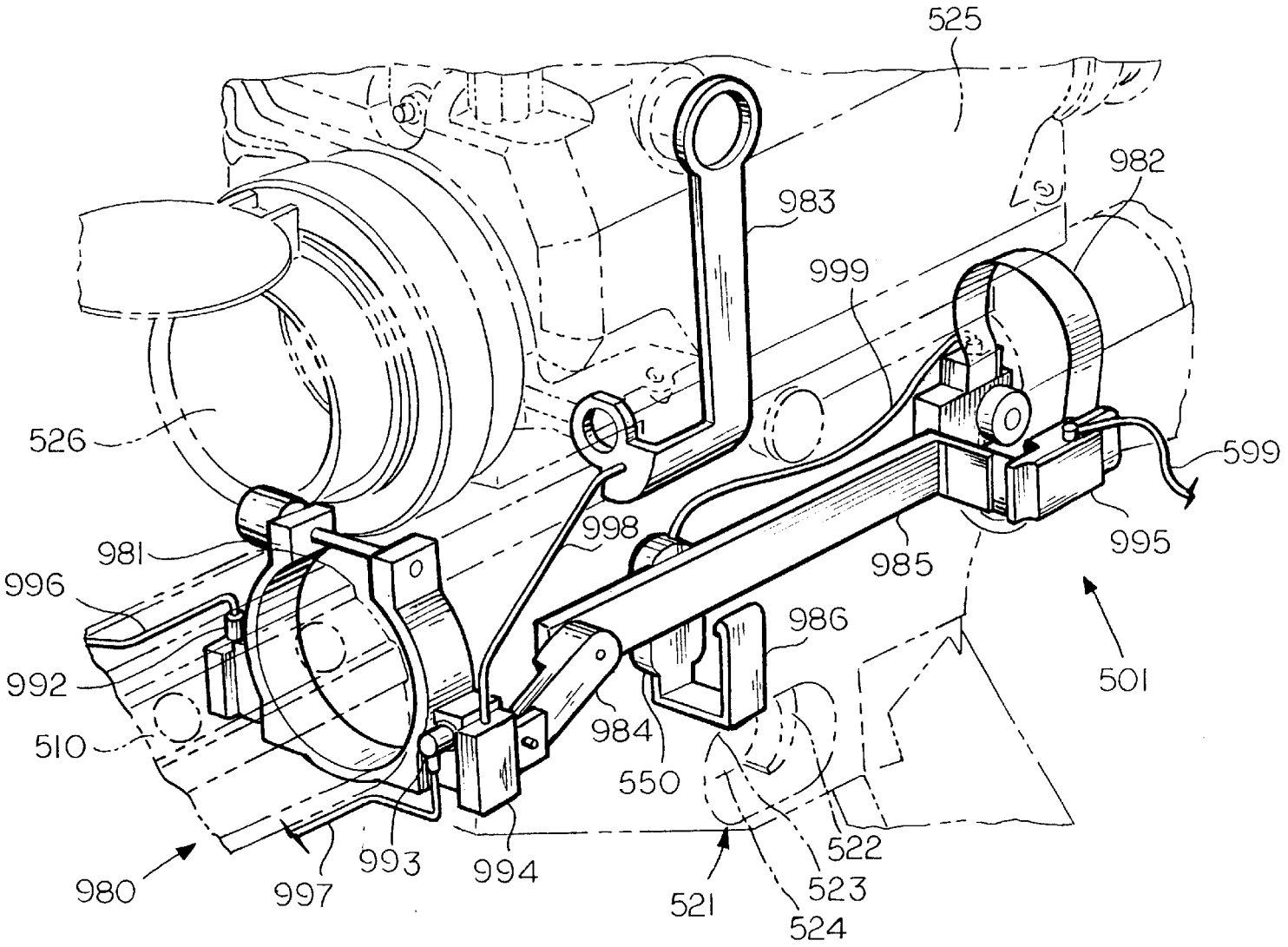
FIG. 5 is an expanded perspective view of the Sensor Segment of the present invention.

The Sensor Segment 980, best shown in FIG. 5, is a molded silicon wiring harness with embedded conductors and shields that is installed as an exterior shell. The shell provides environmental protection and structure for the Sensor Segment 980 and is made of injected molded, glass filled, nylon which supplies adequate support while providing the required flexibility for direct mounting to the rifle 501 or other modular weapon (not shown).

The primary sensor-related components of the LW system 100 are the Thermal Weapon Sight ("TWS") 525, the laser range finder/digital compass assembly ("LRF/DCA") 530, and the video camera ("VC") 535, all of which may be mounted either to the soldier's rifle 501, shown generally in FIG. 2, or another modular weapon (not shown). All sensor components are either off-the-shelf or modified off-the-shelf items. The VC 535 is a Sekai Electronics video camera model RSC-700, the LRF/DCA is a integration of a Fibertek mini-laser range finder and Leica digital compass assembly; and, the TWS is a thermal sighting system developed by Hughes Aircraft for the U.S. Army (military designator AN/PAS13).

The structure of the sensor segment 980 begins with an elongate main support member 985 which is mounted along one side of the central portion of the rifle 501. The main support member 985 is fixed to the rifle 501 at two points by upper receiver clamp 981 and lower receiver clamp 982, as shown in FIG. 5. The remote CRS controls bracket 986 passes through the trigger guard aperture 524 and clamps onto the upper surface of the trigger guard 523, thus holding the CRS remote controls 550 firmly in place. The TWS extension 983 completes the inventory of structural components and serves to both anchor the Thermal Weapon Sight 525 to the central portion 503 of the rifle 501 and provide a protected electrical path from the TWS 525.

All of the external connectors used in the wiring harness assembly 910, including the Sensor Segment 980, are snap-on/off, single shell size miniature connectors which use conventional electromagnetic interference ("EMI") and moisture sealing technology. There are five main connectors in the Sensor Segment 980. The LRF/DCA connector 992 electrically connects the LRF/DCA 530 to the Sensor Segment 980 via cable 996. The video camera connector 993 electrically connects the video camera 535 to the Sensor Segment 980 via cable 997. The TWS connector 994 electrically connects the TWS 525 to the Sensor Segment 980 via able 998. The remote CRS controls 550 are electrically connected to the remote CRS connector 987 via cable 999. Finally, the LW connector 995 electrically connects the Sensor Segment 980 (and thus the other electrical components) via Weapon Segment cable 599 to the microprocessor (not shown) of the CRS 200.

Of course, it should be understood that a wide range of changes and modifications can be made to the preferred embodiment described above. It in therefore intended that the foregoing detailed description be regarded as illustrative rather than limiting and that it be understood that it is the following claims, including all equivalents, which are intended to define the scope of the invention.

What is claimed is:

1. In a fully integrated, multi-functional, warfare system to be worn by an individual, said warfare system having a weapon subsystem, a helmet subsystem, and computer subsystem, and a wiring harness assembly comprising:

an equipment carrier, said equipment carrier being worn by said individual, said equipment carrier having a hollow frame for supporting said equipment carrier and a first strap, one end of said first strap being fastened to said frame in the rear of said individual, said first strap at least partially encircling the torso of said individual, the other end of said first strap being fastened to said equipment carrier in the front of said individual;

a first plurality of wires, said first plurality of wires being contained within said frame, said first plurality of wires being connected to said computer subsystem; and, a second plurality of wires; said second plurality of wires being embedded within said first strap, said second plurality of wires being connected to said first plurality of wires.

2. The wiring harness assembly according to claim 1 further comprising a junction block, said junction block being connected to said second plurality of wires.

3. The wiring harness assembly according to claim 2 wherein said junction block comprises:

a housing; and at least one connector, said at least one connector being attached to said housing.

4. The wiring harness assembly according to claim 2 further comprising:

a third plurality of wires, said third plurality of wires electrically connecting said junction block to said helmet subsystem.

5. The wiring harness assembly according to claim 4 wherein said helmet subsystem comprises:

a helmet, said helmet being worn by said individual; and a display, said display being mounted on said helmet.

6. The wiring harness assembly according to claim 5 wherein said display comprises a component for daytime viewing and a component for nighttime viewing.

7. The wiring harness assembly according to claim 4 further comprises:

a fourth plurality of wires, said fourth plurality of wires electrically connecting said junction block to said weapon subsystem.

8. The wiring harness assembly according to claim 7 wherein said weapon subsystem comprises a shoulder-fired rifle.

9. The wiring harness assembly according to claim 7 wherein said weapon subsystem contains sensor components.

10. The wiring harness assembly according to claim 9 wherein said sensor components comprise:

a video camera, said video camera mounted to said weapon subsystem;

a thermal sight, said thermal sight mounted to said weapon subsystem; and, a laser range finder/digital compass assembly, said laser range finder/digital compass assembly being mounted to said weapon subsystem.

11. The wiring harness assembly according to claim 7 further comprising:

a second strap, one end of said second strap being fastened to said frame in the rear of said individual, said second strap at least partially encircling the torso of said individual, the other end of said second strap being fastened to said equipment carrier in the front of said individual; and a fifth plurality of wires, said fifth plurality of wires being embedded within said second strap, said fifth plurality of wires being connected to said first plurality of wires.

12. The wiring harness assembly according to claim 11 wherein said one end of second strap slidably engages said frame whereby allowing said second strap to be adjusted to fit snugly against the torso of said individual.

13. The wiring harness assembly according to claim 1 wherein said one end of first strap slidably engages said frame whereby allowing said first strap to be adjusted to fit snugly against the torso of said individual.

* * * * *